US008777040B2

(12) United States Patent
Wahl

(10) Patent No.: US 8,777,040 B2
(45) Date of Patent: Jul. 15, 2014

(54) FLASK

(75) Inventor: Andrew C. F. Wahl, Seattle, WA (US)

(73) Assignee: Pacific Market International, LLC, Seattle, WA (US)

( * ) Notice: Subject to any disclaimer, the term of this patent is extended or adjusted under 35 U.S.C. 154(b) by 0 days.

(21) Appl. No.: 13/565,023

(22) Filed: Aug. 2, 2012

(65) Prior Publication Data

US 2014/0034644 A1 Feb. 6, 2014

(51) Int. Cl.
*B65D 51/18* (2006.01)

(52) U.S. Cl.
USPC ..... 220/254.6; 215/273; 215/306; 215/237; 220/254.3; 220/254.8; 220/259.1; 220/259.3; 220/715; D24/224; D7/510

(58) Field of Classification Search
USPC ..... 215/235, 237, 243, 273, 274, 306; 220/254.1, 254.3, 254.6, 254.8, 254.9, 220/256.1, 259.1, 259.3–259.5, 715; D7/510; D24/224
See application file for complete search history.

(56) References Cited

U.S. PATENT DOCUMENTS

| | | | | | |
|---|---|---|---|---|---|
| D44,371 | S | * | 7/1913 | Kopecky | D3/202 |
| D73,990 | S | * | 11/1927 | Young | D9/523 |
| D86,604 | S | * | 3/1932 | Hutcheson | D9/725 |
| D94,814 | S | * | 3/1935 | Dunne | D9/764 |
| 2,447,870 | A | * | 8/1948 | Polcyn | 220/715 |
| 2,585,526 | A | * | 2/1952 | Zautner | 222/192 |
| 3,250,423 | A | | 5/1966 | Curran | |
| D205,910 | S | | 10/1966 | Northrup | |
| D207,128 | S | * | 3/1967 | Kelly | D9/528 |
| D214,239 | S | | 5/1969 | Kemp | |
| D294,557 | S | * | 3/1988 | Jones | D9/524 |
| D306,822 | S | * | 3/1990 | Jones | D9/563 |
| D314,139 | S | | 1/1991 | Ambasz | |
| 4,981,228 | A | | 1/1991 | Kahn | |
| D322,358 | S | * | 12/1991 | Jacober et al. | D3/202 |
| D335,745 | S | * | 5/1993 | Schilthuizen | D34/39 |
| 5,244,113 | A | | 9/1993 | Stymiest | |
| D340,185 | S | * | 10/1993 | Martone | D9/694 |
| D341,322 | S | | 11/1993 | Bondewel | |
| D342,140 | S | | 12/1993 | Sakagami et al. | |
| D345,916 | S | | 4/1994 | Bondewel | |
| D358,219 | S | | 5/1995 | Ushikubo | |
| D380,553 | S | * | 7/1997 | Riekkinen | D24/224 |
| D400,794 | S | | 11/1998 | Takeuchi et al. | |
| D421,547 | S | * | 3/2000 | Demers | D7/510 |

(Continued)

FOREIGN PATENT DOCUMENTS

| | | |
|---|---|---|
| DE | 8008018 | 7/1980 |
| DE | 20304496 | 6/2003 |

*Primary Examiner* — Anthony Stashick
*Assistant Examiner* — Ned A Walker
(74) *Attorney, Agent, or Firm* — Davis Wright Tremaine LLP; George C. Rondeau, Jr.

(57) ABSTRACT

A beverage container or flask that includes a lower body portion and a selectively openable upper body portion. The upper body portion is configured to include a fastener that allows a user to selectively lock the panel in place by pivoting the upper body portion relative to the remainder of the flask. When the openable upper body portion is locked in place on the remainder of the flask, the upper body portion provides a leak proof seal such that a liquid may be contained in the flask without escaping. When the openable upper body portion is opened, access to an interior volume or compartment of the flask is provided, which facilitates simplified and more effective cleaning of the flask.

15 Claims, 12 Drawing Sheets

(56) References Cited

U.S. PATENT DOCUMENTS

| | | | | | |
|---|---|---|---|---|---|
| 6,098,834 | A | * | 8/2000 | Hatsumoto et al. | 220/715 |
| 6,119,888 | A | * | 9/2000 | Goto et al. | 220/592.27 |
| D438,096 | S | * | 2/2001 | Lehnert | D9/694 |
| D469,018 | S | | 1/2003 | Allanson et al. | |
| D471,455 | S | | 3/2003 | Laveault et al. | |
| D503,113 | S | | 3/2005 | Gillispie | |
| D505,294 | S | | 5/2005 | Gauss | |
| D510,235 | S | * | 10/2005 | Sorensen | D7/510 |
| D511,457 | S | | 11/2005 | Biesecker et al. | |
| 6,981,601 | B2 | | 1/2006 | Laveault et al. | |
| 7,021,486 | B1 | | 4/2006 | Hurlbut | |
| D521,230 | S | * | 5/2006 | Linz et al. | D3/202 |
| D526,742 | S | * | 8/2006 | Smith | D27/157 |
| D539,607 | S | * | 4/2007 | Lapsker | D7/510 |
| D541,426 | S | | 4/2007 | Sato et al. | |
| D581,268 | S | | 11/2008 | Heath et al. | |
| D587,969 | S | * | 3/2009 | Gilbert | D7/510 |
| D588,411 | S | * | 3/2009 | Watanabe | D7/510 |
| D604,165 | S | | 11/2009 | Gilbert | |
| D611,811 | S | * | 3/2010 | Gilbert | D9/443 |
| D611,821 | S | * | 3/2010 | Gabrielsson et al. | D9/517 |
| D614,497 | S | * | 4/2010 | Pola | D9/523 |
| D617,198 | S | * | 6/2010 | Lee et al. | D9/529 |
| D623,058 | S | * | 9/2010 | Gilbert | D9/443 |
| D624,357 | S | * | 9/2010 | George | D7/396.2 |
| 2,938,356 | A1 | | 1/2011 | Wahl | |
| D650,629 | S | * | 12/2011 | Gilbert | D7/392.1 |
| D651,044 | S | * | 12/2011 | Gilbert | D7/510 |
| D651,852 | S | * | 1/2012 | George | D7/510 |
| D660,648 | S | * | 5/2012 | Gilbert | D7/510 |
| D661,551 | S | * | 6/2012 | Gilbert | D7/629 |
| 8,464,895 | B2 | * | 6/2013 | Gilbert et al. | 220/703 |
| 2006/0226160 | A1 | * | 10/2006 | Elsaden et al. | 220/715 |
| 2012/0181283 | A1 | * | 7/2012 | Wahl | 220/500 |
| 2012/0325815 | A1 | * | 12/2012 | Gilbert et al. | 220/264 |

* cited by examiner

FLASK

BACKGROUND OF THE INVENTION

1. Field of the Invention

The present invention is directed generally to beverage containers and more particularly to beverage containers that include a selectively openable panel that provides access to an internal compartment to facilitate easy cleaning of the containers.

2. Description of the Related Art

Beverage containers come in numerous shapes and sizes. Many beverage containers include a body portion having a hollow interior volume, a neck portion coupled to the body portion that is substantially narrower than the body portion, and a mouth or opening coupled to a top portion of the neck portion that is operative to permit passage of liquid between the interior of the body portion and the external environment. For many beverage containers, washing the interior of the body portion after use may be a difficult task since the relatively small opening and neck portion of the container may severely limit access to the interior portion of the container.

DETAILED DESCRIPTION OF THE INVENTION

The present invention is directed to a beverage container or flask that includes lower body portion and a selectively openable upper body portion. The openable panel is hingedly coupled to the remainder of the flask. When the upper body portion is locked in place on the remainder of the flask, the upper body portion provides a leak proof seal such that a liquid may be contained in the flask without escaping. The openable upper body portion feature of the flask permits access to an interior volume or compartment of the flask, which facilitates simplified and more effective cleaning of the interior of the flask. This is in contrast to flasks or beverage containers in which the only access to an interior compartment is through a relatively small mouth or drinking opening. As an example, a user may open the upper body portion of the flask and then insert the flask into a dishwasher for efficient and effective cleaning thereof.

Figure 7:
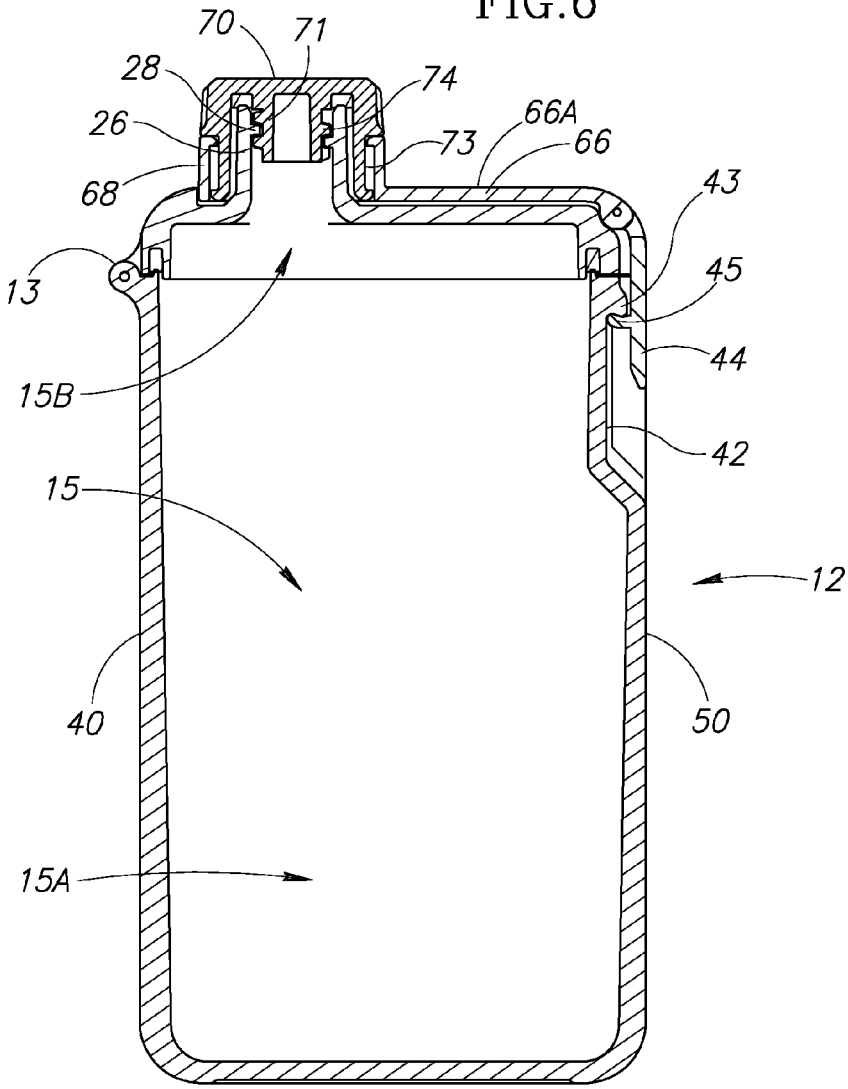
FIG. 7 is cross-sectional view of the flask taken along the line 7-7 of FIG. 6.
Figure 8:
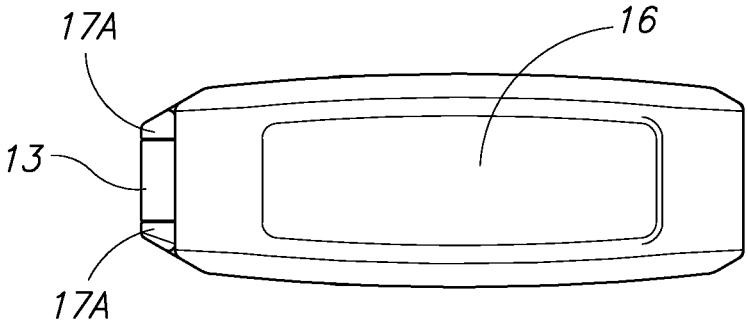
FIG. 8 is a bottom plan view of the flask.
Figure 12:
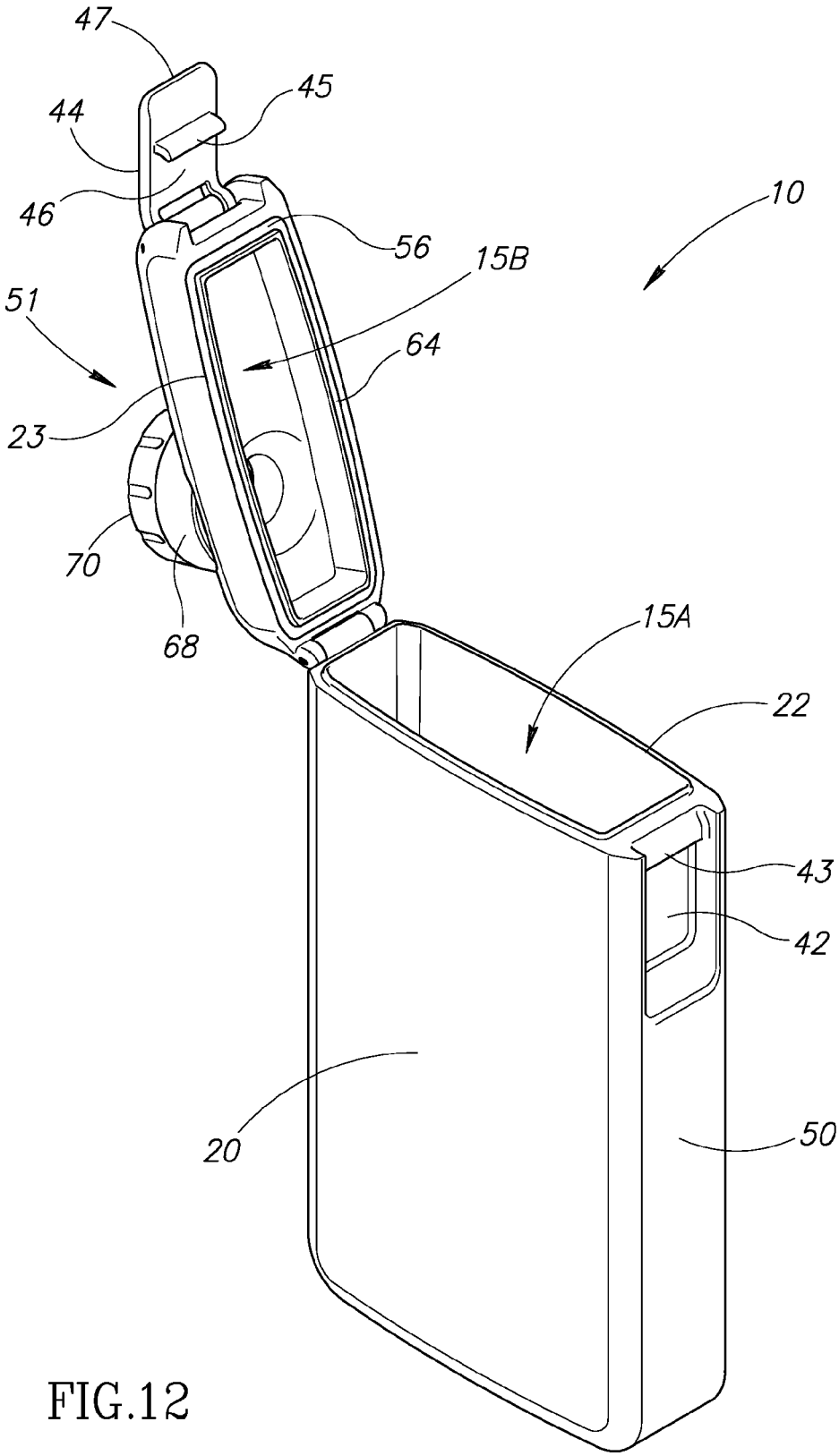
FIG. 12 is a top-rear left side perspective view of the flask with the upper body portion in an open position.

An embodiment of a flask 10 according to the present invention is depicted in the figures. Referring initially to FIGS. 1-8, the flask 10 includes a body portion 12. The body portion 12 includes a lower body portion 11 comprising a right side panel 18, a left side panel 20, a front panel 40, a rear panel 50, and a bottom panel 16. The body portion 12 also comprises a selectively openable upper body portion 14 comprising a top surface 14B, a left side panel 14C, a right side panel 14D, a front end portion 17, and a rearward end portion 19. The flask 10 also includes a cap 70 that is removably coupled to a cylindrical neck portion 26 (see FIG. 9) that extends upwardly from the upper body portion 14 of the flask and defines an opening 30 that provides a fluid connection into an interior compartment 15 (see FIG. 7) that houses a liquid. As shown in FIGS. 7 and 12, the interior compartment 15 comprises a lower interior compartment 15A formed by the lower body portion 11 and an upper interior compartment 15B formed by the upper body portion 14. As may best be viewed in FIGS. 7 and 9, the neck portion 26 includes internal threads 28 configured to threadably engage external threads 74 disposed on a downwardly extending cylindrical wall 71 of the cap 70. In operation, a user may threadably disengage the cap 70 from the neck portion 26 of the flask 10 by grasping an outer gripping surface 72 of the cap, fill the flask with a liquid or pour liquid therefrom, and then return the cap securely onto the neck portion to seal closed the interior compartment 15.

As shown in FIGS. 9, 10, 13, and 14, a flexible cap attachment strap 66 is positioned over a recessed portion 14A of the upper body portion 14. The depth of the recessed portion 14A is substantially the same as the thickness of the cap attachment strap 66 such that a top surface 66A of the cap attachment strap is substantially coplanar or flush with a top surface 14B of the upper body portion 14 (see FIG. 1). The cap attachment strap 66 comprises a loop portion 68 configured to securely attach the cap 70 to the cap attachment strap 66. Since it is desirable for the cap 70 to be freely rotatable so that it may be threadably engaged with the neck portion 26, the loop portion 68 is sized to loosely fit within a groove 73 of the cap 70, which permits the cap 70 to be rotated by a user. Thus, since the cap 70 is secured to the flask 10 via the cap attachment strap 66, a user may disengage the cap 70 from the neck 26 without having to be concerned that the cap may be misplaced.

Figure 9:
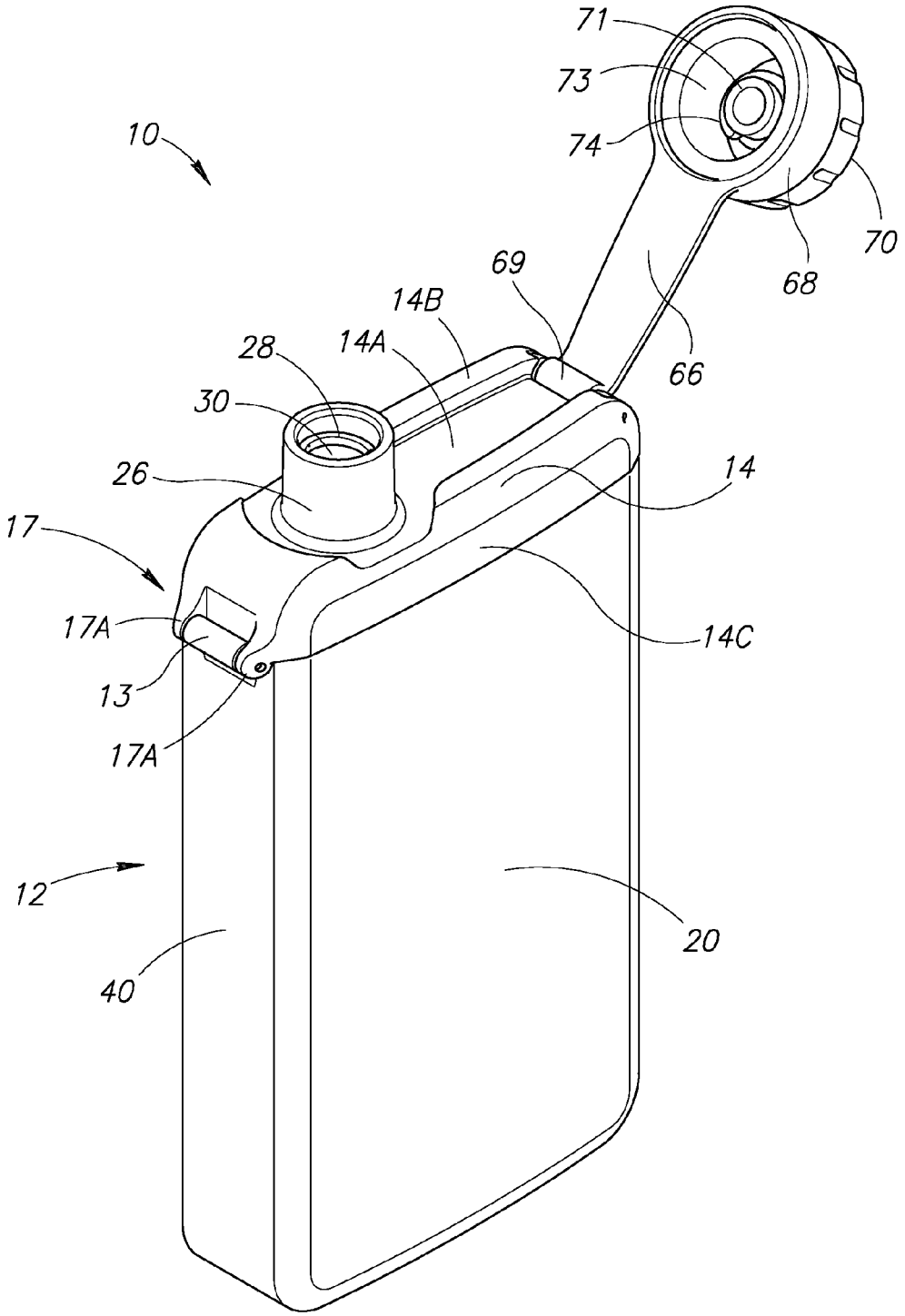
FIG. 9 is a top-front left side perspective view of the flask with a cap in a removed position.
Figure 10:
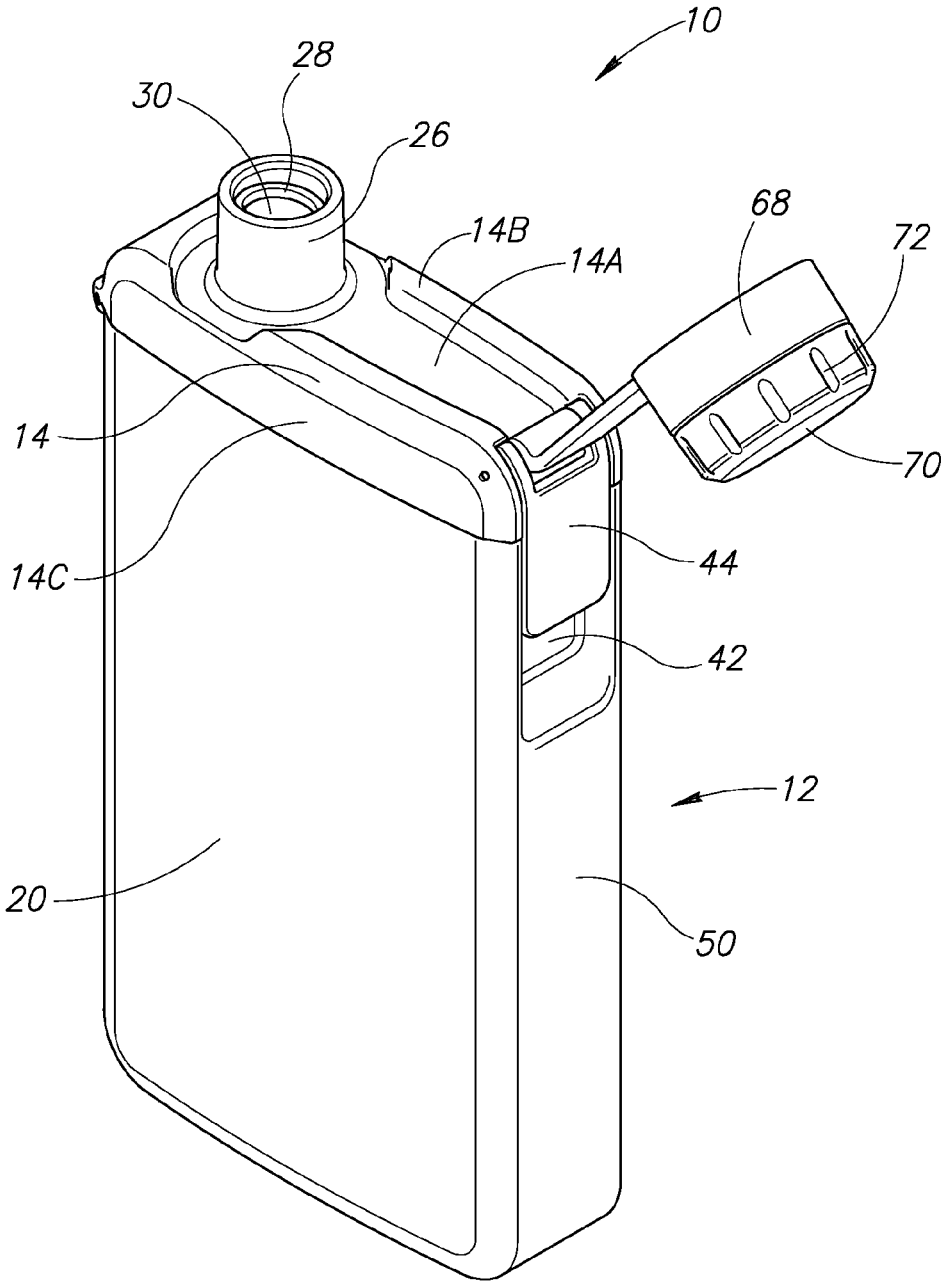
FIG 10 is a top-rear left side perspective view of the flask with the cap in the removed position.
Figure 14:
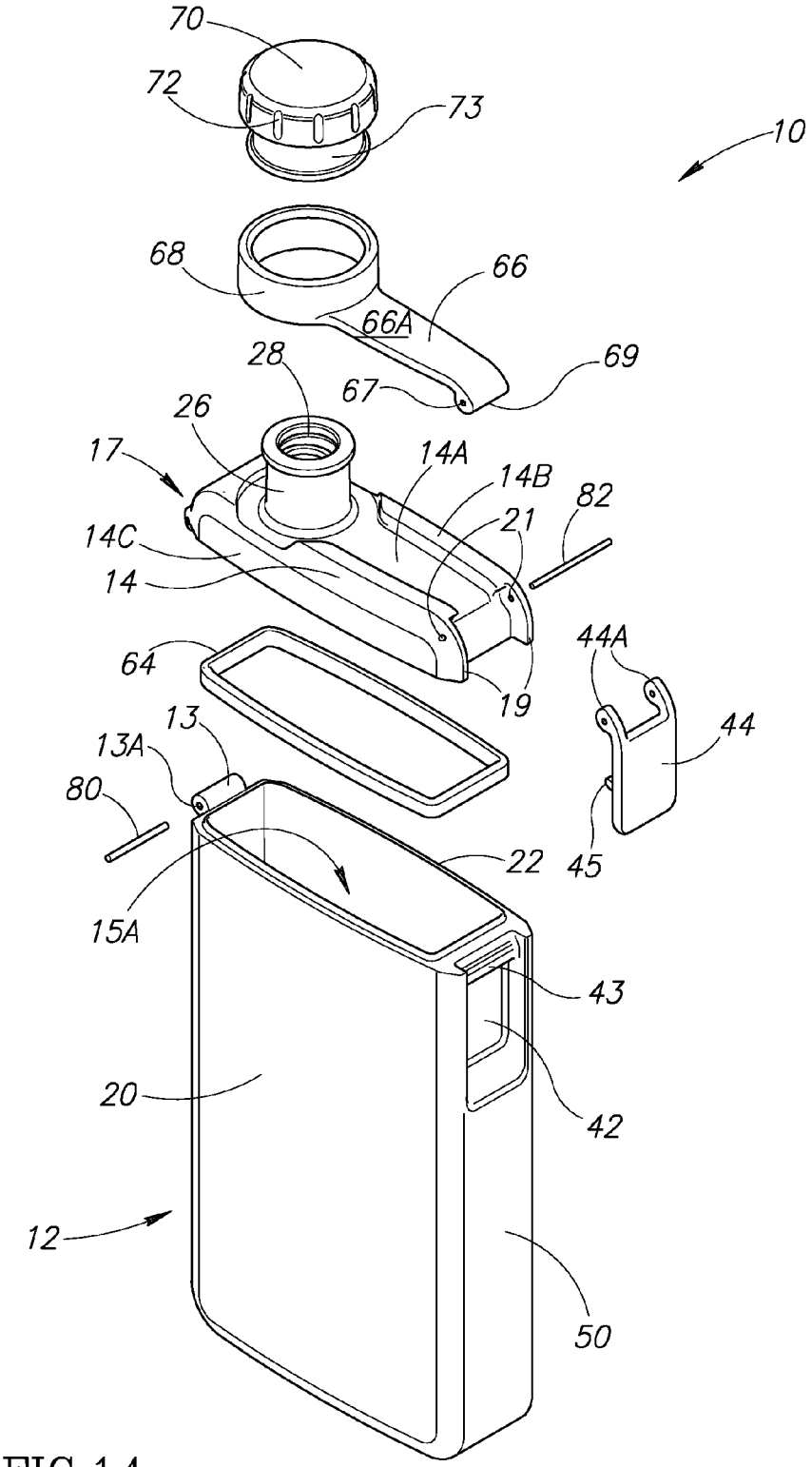
FIG. 14 is a top-rear left side exploded perspective view of the flask.

As shown in FIGS. 9 and 14, the cap attachment strap 66 is hingedly coupled to the upper body portion 14 near the rearward end portion 19 thereof. The cap attachment strap 66 includes connection portion 69 having an aperture 67 therein configured to receive a second hinge pin 82 that has its opposite end portions received in apertures 21 of the rearward end portion 19 of the upper body portion 14. This allows the cap attachment strap 66 to be rotated between a closed position wherein the cap 70 is coupled to the neck 26 (see FIG. 1) to an open position wherein the cap 70 is disengaged from the neck (see FIG. 9).

As shown in FIG. 12, the openable upper body portion 14 comprises a seal coupling portion 56 (on an underside thereof) configured for coupling with a seal 64. The upper body portion 14, once coupled to the seal 64 as shown in FIG. 12, may be securely but removably positioned over and engaged with a top perimeter body portion or edge 22 of the lower body portion 11 of the body portion 12 to define the interior compartment 15. The upper body portion 14 includes a bottom perimeter body portion or edge 23 that is aligned with the top perimeter body portion 22 of the lower body portion 11 when the upper body portion is positioned over the lower body portion. The openings formed by the bottom perimeter body portion 23 and the top perimeter body portion 22 are substantially the same size, and both are multiple times larger in area than the drinking opening 30. The seal 64 may be formed from a sufficiently flexible material (e.g., rubber, silicone, or the like) such that when pressed onto the perimeter portion 22, a leak proof (i.e., fluid-tight) seal is formed between the body portion 12 and the upper body portion 14.

Figure 11:
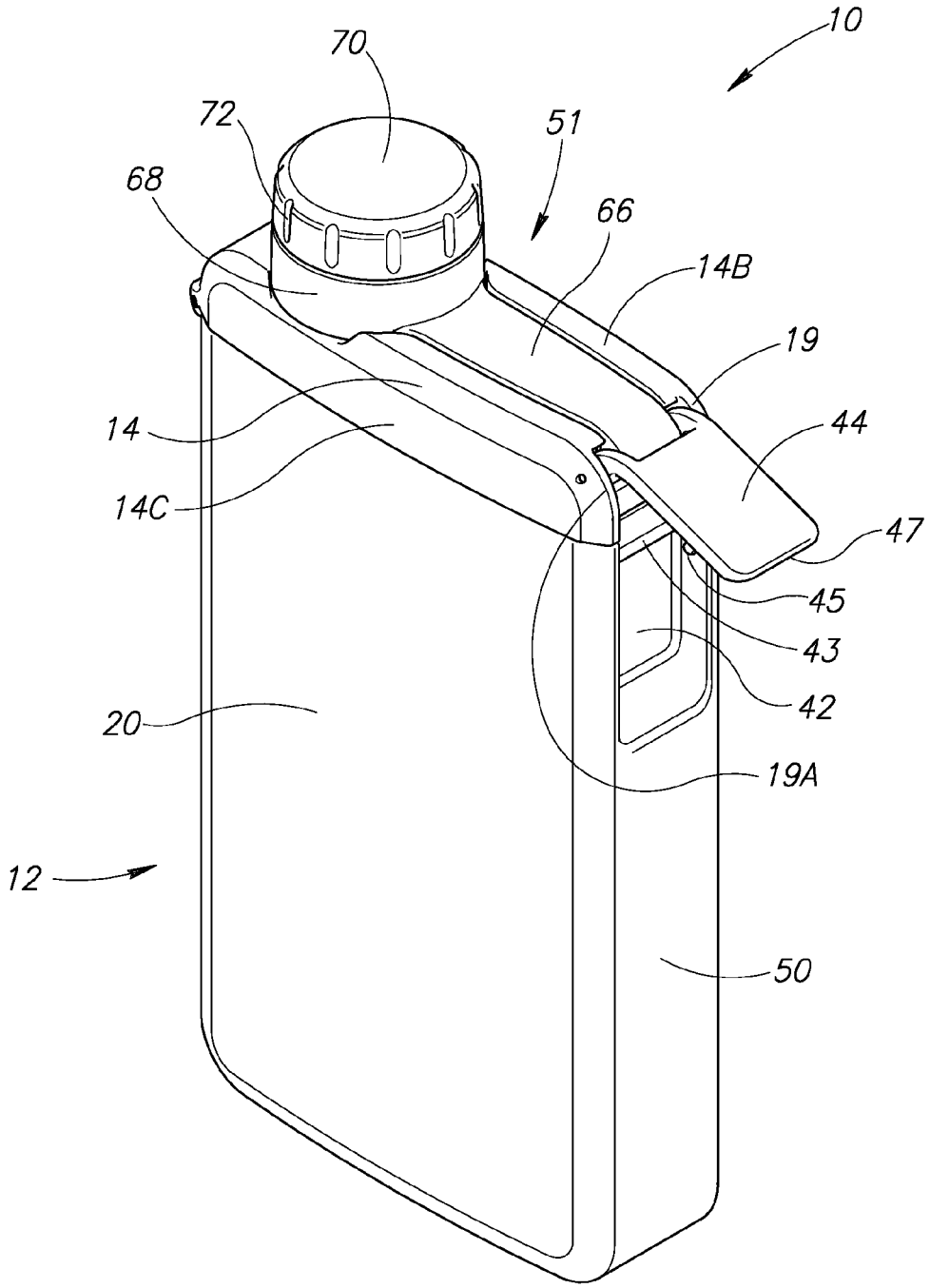
FIG. 11 is a top-rear left side perspective view of the flask with a locking tab of a upper body portion in an unlocked position.
Figure 13:
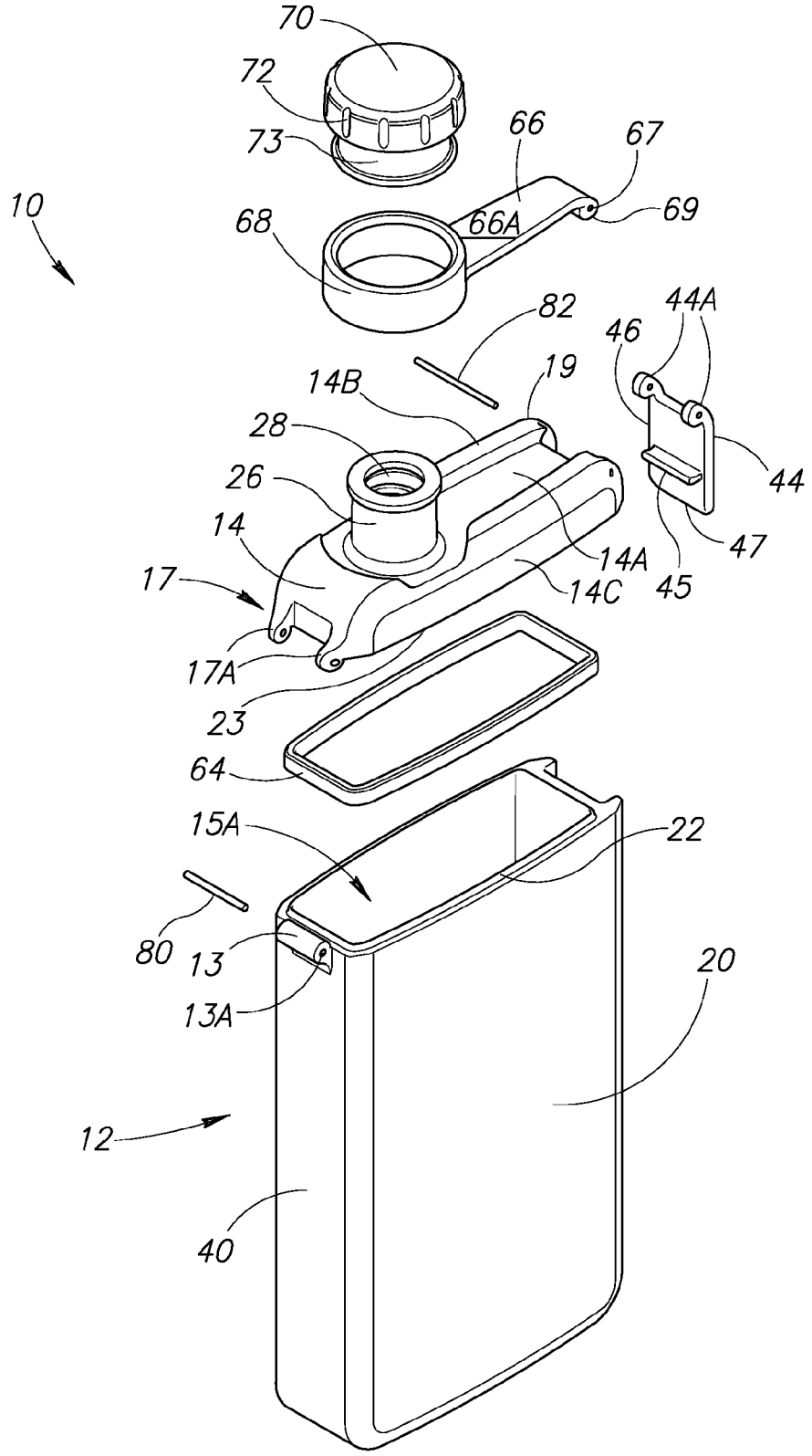
FIG. 13 is a top-front left side exploded perspective view of the flask.

Referring now to FIGS. 11 and 12, the upper body portion 14, the cap attachment strap 66, and the cap 70 together form a selectively pivotable assembly 51. As shown in FIGS. 9 and 13, the front end portion 17 of the upper body portion 14 comprises spaced apart arm portions 17A, each having an aperture therein configured to receive a different end portion of a first hinge pin 80 that passes through an aperture 13A in a upper body portion coupling portion 13 of the body 12, thereby hingedly coupling the upper body portion 14 to the body 12 at the front side thereof. In operation, a user may selectively pivot the assembly 51 between a closed or sealed position (see FIG. 11) and an open position (see FIG. 12). In this regard, the interior portion of the body portion 12 (i.e., the compartment 15) is fully accessible, which may be advantageous by allowing simplified washing of the flask 10.

As may best be viewed in FIGS. 11, 12, and 13, the assembly 51 comprises a locking tab 44 that is hingedly coupled to the left rearward portion 19 of the upper body portion 14 via the second hinge pin 82, which is passed through apertures in spaced apart arm portions 44A of the locking tab. The locking tab 44 is selectively rotatable between a locked position wherein it is positioned downward and substantially coplanar or flush with the rear panel 50 of the body 12 (see FIG. 1), and an unlocked position wherein it extends outward and has a free end portion 47 spaced apart from the rear panel 50 (see FIG. 11).

Figure 1:
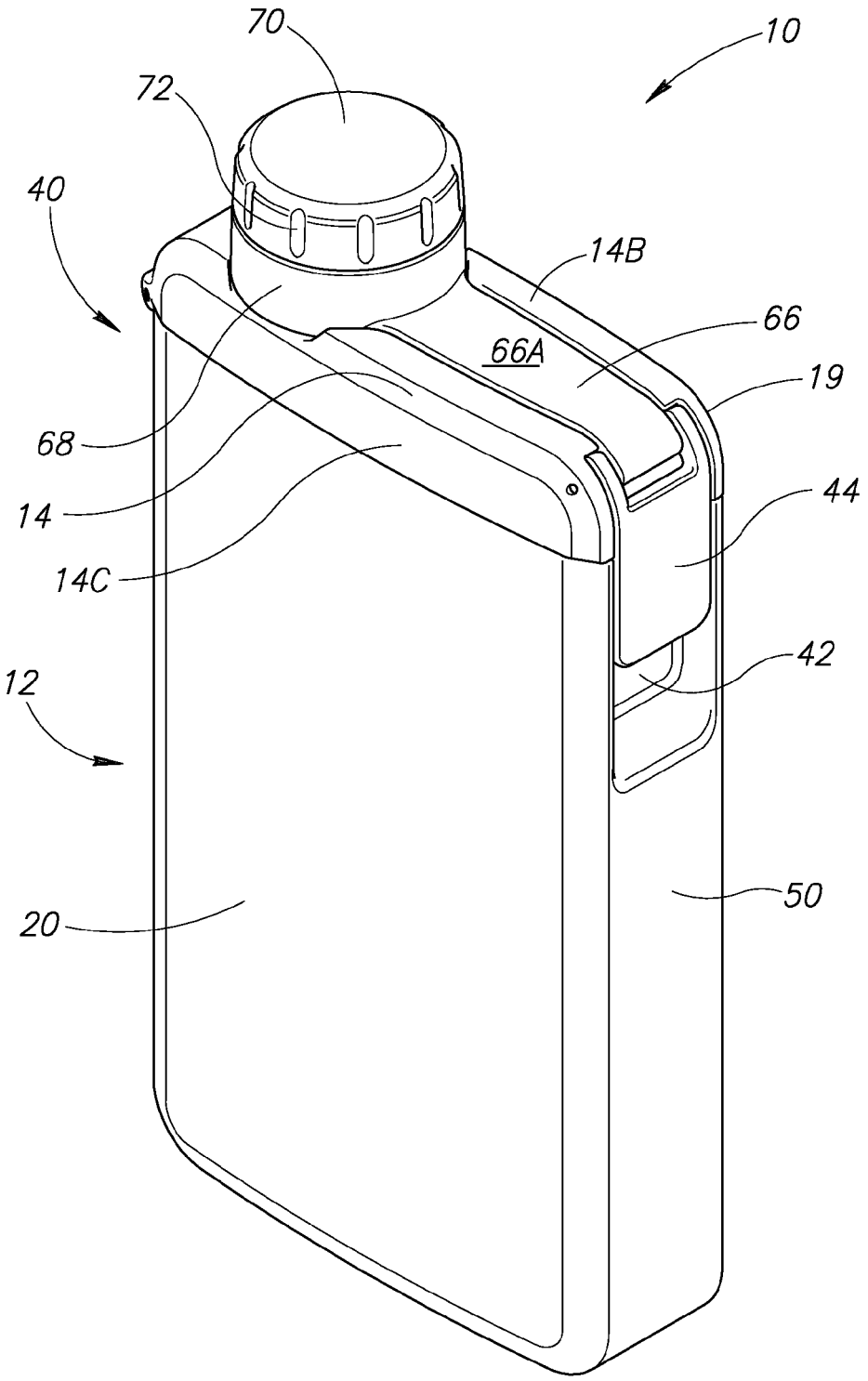
FIG. 1 is a top-rear left side perspective view of a flask in accordance with an embodiment of the present invention.
Figure 2:
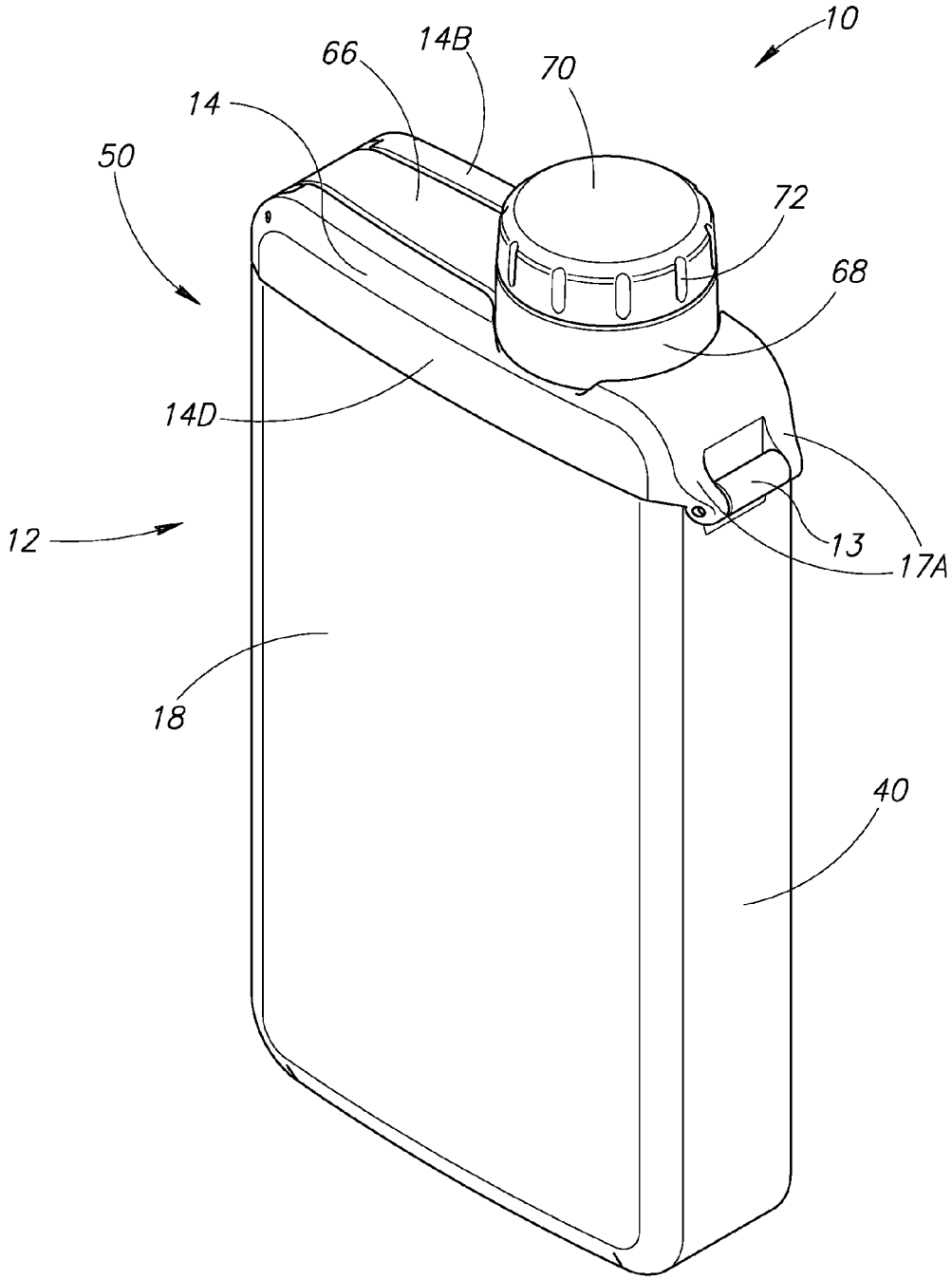
FIG. 2 is a top-front right side perspective view of the flask.
Figure 3:
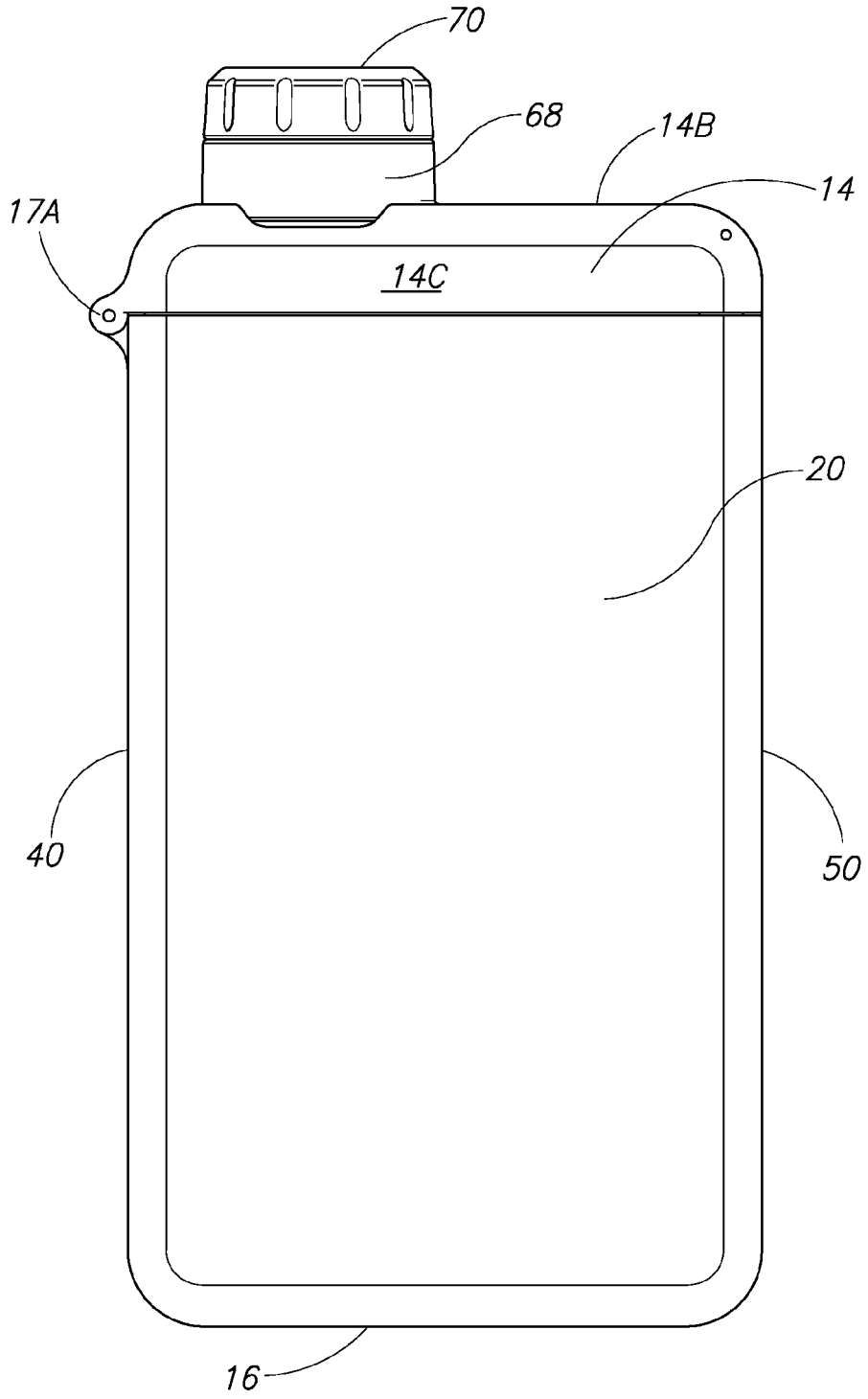
FIG. 3 is a left side elevational view of the flask.
Figure 4:
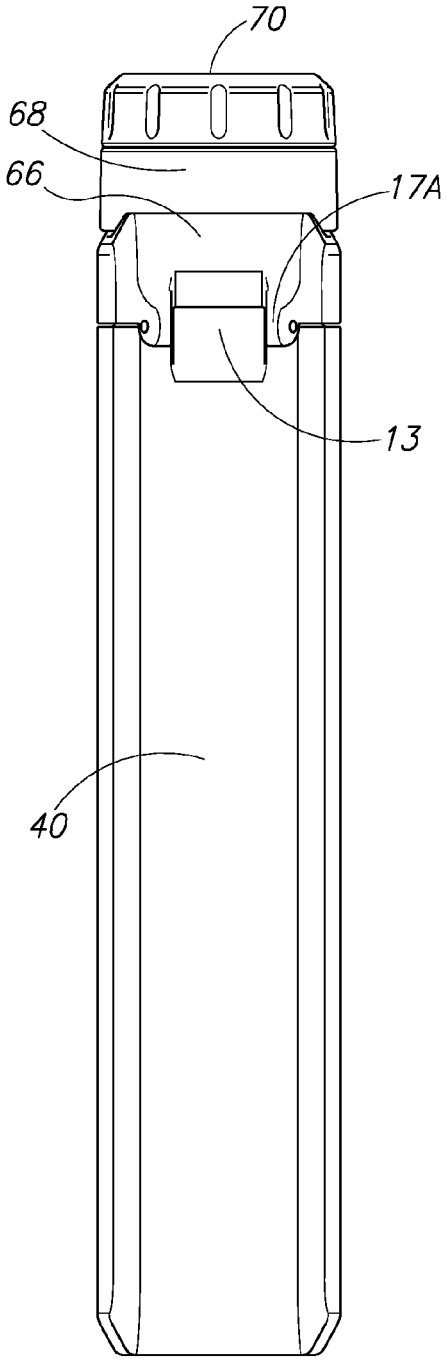
FIG. 4 is a front elevational view of the flask.
Figure 5:
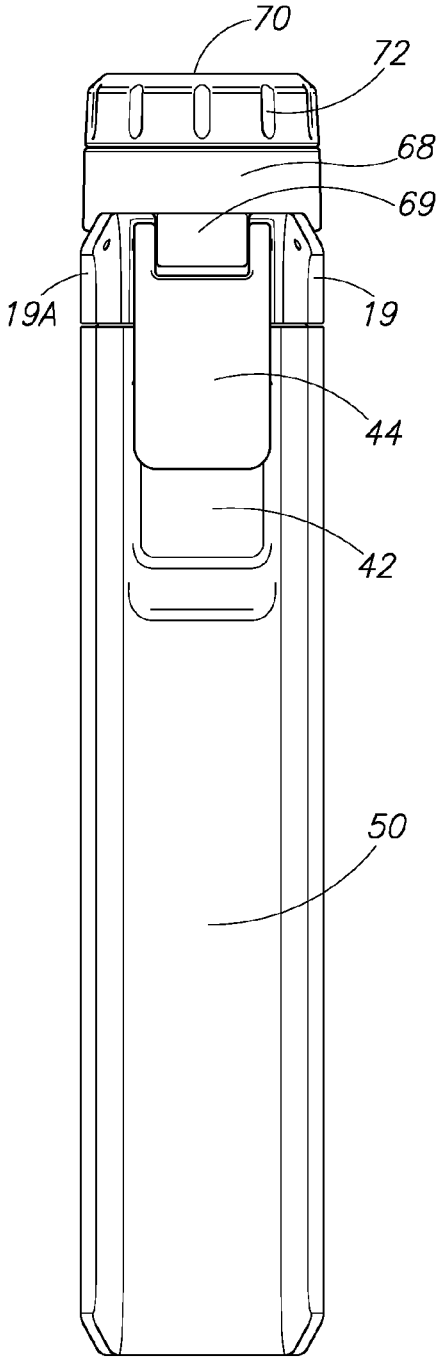
FIG. 5 is a rear elevational view of the flask.
Figure 6:
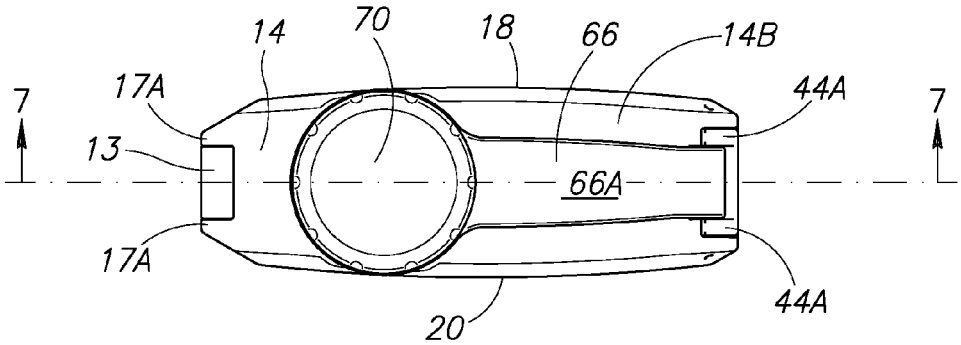
FIG. 6 is a top plan view of the flask.

The rear panel 50 includes a recessed portion 42 that permits a user's finger to contact the free end portion 47 and/or an inner surface 46 of the locking tab 44 to apply an outward force thereto to rotate the locking tab from the locked position shown in FIG. 1 into the unlocked position shown in FIG. 11. The recessed portion 42 of the rear panel 50 includes a raised outwardly projecting latch member 43 configured to mate with a raised inwardly projecting latch member 45 positioned on the inner surface 46 of the locking tab 44. When the user presses the locking tab 44 inward toward the locked position, the latch members 43 and 45 contact each other and flex to form an interference latch (e.g., a snap fit or lock) between the locking tab and the body 12.

As discussed above, the flask 10 is configured to permit the pivotable assembly 51 to be selectively locked onto the lower body portion 11 of the body portion 12 of the flask to form the fluid-tight interior compartment 15 operative to contain a liquid therein. When the user desires to open the assembly 51 (e.g., for washing the flask 10), the user may unlock the locking tab 44 and rotate the assembly 51 upward into the open position shown in FIG. 12.

The foregoing described embodiments depict different components contained within, or connected with, different other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected", or "operably coupled", to each other to achieve the desired functionality.

While particular embodiments of the present invention have been shown and described, it will be obvious to those skilled in the art that, based upon the teachings herein, changes and modifications may be made without departing from this invention and its broader aspects and, therefore, the appended claims are to encompass within their scope all such changes and modifications as are within the true spirit and scope of this invention. Furthermore, it is to be understood that the invention is solely defined by the appended claims. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.).

It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations).

Accordingly, the invention is not limited except as by the appended claims.

The invention claimed is:

1. A beverage container, comprising:

a lower body portion comprising:

one or more panels that form a lower body portion interior volume configured for receiving a liquid within the lower body portion interior volume, including a first side panel having a first hinge located at an upper end portion of the first side panel, and a second side panel having an outwardly projecting latch member; and an upward facing perimeter portion defining a lower body portion opening configured for allowing access to the lower body portion interior volume; and an upper body portion hingedly coupled to the lower body portion at the first hinge, the upper body portion comprising:

a top wall comprising:

first end portion;

a second end portion opposite the first end portion; and a second hinge disposed at the second end portion;

a downward facing perimeter portion extending downwardly from the top wall and defining an upper body portion opening, the top wall and downward facing perimeter portion of the upper body portion forming an upper body portion interior volume, the upper body portion being selectively pivotable between:

a closed position wherein the downward facing perimeter portion of the upper body portion is adjacent to the upward facing perimeter portion of the lower body portion and covers the lower body portion opening, and an open position wherein the downward facing perimeter portion of the upper body portion is spaced apart from the upward facing perimeter portion of the lower body portion to provide access to the upper body portion interior volume and the lower body portion interior volume;

a neck extending upwardly from the top wall and defining a drinking opening having a cross-sectional area that is smaller than a cross-sectional area of the lower body portion opening;

a cap removably covering the drinking opening;

a locking portion hingedly coupled to the second hinge, the locking portion configured to engage the latch member of the lower body portion to selectively secure the upper body portion in the closed position; and a cap attachment strap comprising:

a first end portion coupled to the cap; and a second end portion opposite the first end portion, the second end portion pivotally coupled to the second hinge.

2. The beverage container of claim 1, wherein the locking portion comprises an inwardly projecting latch member, the outwardly projecting latch member of the second side panel of the lower body portion and the inwardly projecting latch member enabling a snap fit connection.

3. The beverage container of claim 1, wherein the downward facing perimeter portion of the upper body portion comprises a downward facing seal engagement portion coupled to a seal, wherein the seal is disposed between the downward facing perimeter portion of the upper body portion and the upward facing perimeter portion of the lower body portion when the upper body portion is in the closed position.

4. The beverage container of claim 1, wherein the cap comprises a groove, and the first end portion of the cap attachment strap comprises a loop portion configured to loosely fit within the groove of the cap to permit the cap to be rotated by a user.

5. The beverage container of claim 1, wherein the cap comprises a neck engagement portion and the neck comprises a cap engagement portion configured for selective coupling with the neck engagement portion of the cap.

6. The beverage container of claim 5, wherein the neck engagement portion of the cap comprises internal threads and the cap engagement portion of the neck comprises external threads.

7. The beverage container of claim 1, wherein the one or more panels of the lower body portion further includes a front panel and a rear panel, the first side panel and the second side panel having a first width and the front panel and the rear panel having a second width, wherein the second width is substantially greater than the first width.

8. The beverage container of claim 1, further comprising an upper recess in the second side panel of the lower body portion having the latch member of the lower body portion located within the upper recess.

9. A beverage container assembly, comprising:

a body comprising:

a bottom panel;

an upper rim defining a top opening;

a front panel extending between the bottom panel and the upper rim;

a back panel opposite the front panel and extending between the bottom panel and the upper rim;

a left side panel extending between the bottom panel and the upper rim, the left side panel having a first closure hinge portion adjacent the upper rim; and a right side panel extending between the bottom panel and the upper rim, the right side panel having a first latch member adjacent the upper rim; and a pivotal closure comprising:

a top wall having a recess;

a drinking spout extending upwardly from the top wall;

a skirt extending downwardly from the top wall and configured to engage the upper rim of the body, the skirt comprising:

a first end portion having a second closure hinge portion coupled to the first closure hinge portion to form a primary hinge for pivoting the pivotal closure between a primary open position and a primary closed position; and a second end portion having a multipurpose hinge portion;

a tethered cap comprising:

a closed top;

an exterior wall extending downwardly from the closed top;

a threaded interior stopper for coupling with the drinking spout; and a pivotal strap having a first end portion coupled to the exterior wall and a second end portion having a tether hinge portion coupled to the multipurpose hinge portion of the skirt to form a secondary hinge for pivoting the tethered cap between a secondary open position and a secondary closed position; and a locking tab comprising:

a first end portion having a second latch member configured for engagement with the first latch member of the body to secure the pivotal closure in the primary closed position; and a second end portion having a locking tab hinge portion coupled to the multipurpose hinge portion of the skirt.

10. The beverage container assembly of claim 9, further comprising an annular seal disposed between the skirt of the pivotal closure and the upper rim of the body, the annular seal sealing the pivotal closure to the body when the pivotal closure is in the primary closed position.

11. The beverage container assembly of claim 9, the exterior wall of the tethered cap further comprising a groove and the pivotal strap further comprising a loop portion at the first end portion of the pivotal strap, the loop portion configured to loosely fit within the groove to permit rotation of the tethered cap.

12. The beverage container assembly of claim 9, wherein the drinking spout is proximal to the primary hinge and distal to the secondary hinge.

13. The beverage container assembly of claim 9, wherein the pivotal strap is seated in the recess of the top wall of the pivotal closure.

14. The beverage container assembly of claim 9, the drinking spout further comprising a threaded exterior wall configured to engage the threaded interior stopper of the tethered cap when the tethered cap is in the secondary closed position.

15. The beverage container assembly of claim 9, the right side panel of the body further comprising a recess adjacent the upper rim, wherein the first latch member projects outwardly from a top portion of the recess of the body.

* * * * *